US006138593A

United States Patent [19]

Schwarz et al.

[11] Patent Number: 6,138,593

[45] Date of Patent: Oct. 31, 2000

[54] SEWING MACHINE WITH A BALANCE WHEEL

[75] Inventors: Jürgen Schwarz, Trippstadt; Gerhard Ruf, Karlsruhe, both of Germany

[73] Assignee: G.M. Pfaff Aktiengesellschaft, Germany

[21] Appl. No.: 09/475,895

[22] Filed: Dec. 30, 1999

[51] Int. Cl.[7] ..... D05B 69/30

[52] U.S. Cl. ..... 112/283; 474/903

[58] Field of Search ..... 112/270, 217.3, 112/283; 74/552, 554; 474/903; 403/372, 409.1

[56] References Cited

U.S. PATENT DOCUMENTS

| | | | |
|---|---|---|---|
| 140,982 | 7/1873 | Williams | 112/283 |
| 195,436 | 9/1877 | Baker | 112/283 |
| 3,225,624 | 12/1965 | Creter | 112/283 |
| 4,583,419 | 4/1986 | Weisz | 112/283 X |
| 4,700,646 | 10/1987 | Kamiya | 112/283 X |

*Primary Examiner*—Ismael Izaguirre
*Attorney, Agent, or Firm*—McGlew and Tuttle, P.C.

[57] ABSTRACT

A sewing machine with a balance wheel (1), which is detachably fastened on the arm shaft (15). The balance wheel (1) is secured against rotation by the cooperation of a carrier pin (17) transversely protruding from the arm shaft (15) with two axially extending recesses (7) in the balance wheel hub (1), which said recesses are open at one end. The wheel is secured axially by the cooperation of an elastic finger (9), which is fastened to the balance wheel (1) and has a mounting hole (12), with the carrier pin (17).

14 Claims, 1 Drawing Sheet

SEWING MACHINE WITH A BALANCE WHEEL

FIELD OF THE INVENTION

The present invention pertains to a sewing machine with a arm shaft and with a balance wheel detachably fastened to it and more particularly to a balance wheel with a hub, a plurality of ribs protruding from the hub and with a pot-shaped outer part, which is connected to the ribs and has a front-side section and a cylindrical section.

BACKGROUND OF THE INVENTION

It has been known in sewing machines from U.S. Pat. No. 4,583,419 that a balance wheel made of plastic, which also acts as a drive wheel at the same time, is detachably fastened to the arm shaft of the sewing machine and that it is secured against rotation. The balance wheel has, among other things, a hub and a plurality of ribs radially protruding therefrom. A transversely protruding screw, which has a cylindrical collar and a truncated cone-shaped head, is used to secure the balance wheel against rotation. The collar of the screw engages an axially extending recess of the hub, while the head of the screw is accommodated between two adjacent ribs. To reliably transmit the torque, the flexural strength and the wear resistance of the said two ribs is increased by a plug-in wedge made from a steel plate such that the head of the screw is supported on two corresponding legs of the plug-in wedge. A spring bent in the shape of a U, whose middle part is located in an annular groove of the arm shaft and whose bent legs engage correspondingly shaped slots of two other ribs of the balance wheel, is used to secure the balance wheel axially.

This type of fastening is highly complicated due to the use of a rather large number of specially manufactured and therefore not commercially available components. Even though it would be possible to eliminate the plug-in wedge, which increases the flexural strength and the wear resistance, if this prior-art type of balance wheel fastening were also used for manually operated balance wheels, which do not need to transmit any motor torque, at least the specially manufactured U-shaped spring for axially securing the balance wheel should still be there.

SUMMARY AND OBJECTS OF THE INVENTION

The primary object of the present invention is to achieve a simple axial securing of the balance wheel in sewing machines with a balance wheel detachably fastened to the arm shaft.

According to the invention, a sewing machine arm shaft balance wheel is provided with a hub having at least one axially extending recess, the recess being open toward a hub inner front side and corresponding to a radially protruding carrier pin fastened in the arm shaft. The recess is provided in the hub to secure the balance wheel against rotation. A plurality of ribs are provided protruding from the hub. A pot-shaped outer part is connected to the ribs. The pot-shaped outer part has a front-side section and a cylindrical section. An elastic holding element is provided for axially securing the balance wheel. The elastic holding element comprises an elastic finger connected to the balance wheel and having a free end and arranged extending essentially in parallel to the arm shaft. The elastic finger having a mounting hole for the carrier pin in the area of the free end.

A positive-locking axial securing is achieved in an especially simple manner by the measure of providing an elastic finger as a holding means at the balance wheel and of providing it with a mounting hole for the carrier pin, which is present anyway.

The finger may be designed either as an insert extrusion-coated at one end, e.g., in the form of a leaf spring, or as an integral component of the balance wheel. An even greater simplification is achieved especially in the second case, because the finger is inherently a partial section of the balance wheel connected to it in one piece.

Due to the beveling at the end of the finger and the recess opposite the finger in the cylindrical section of the balance wheel, the balance wheel can be mounted without problems and it can also be removed in a likewise simple manner by means of a rod-shaped tool, which is to be passed through the recess and is to be placed under the finger.

A limiting stop prevents may be provided to limiting the finger from being deformed or even broken off during the removal of the balance wheel. The annular groove, already milled at the time of the manufacture of the arm shaft, offers the advantage that the burr formed during the subsequent drilling of the mounting hole for the carrier pin will be located within the annular groove, where it causes no problems and therefore it does not need to be removed by an additional operation.

Due to the measure of allowing the carrier pin to protrude with both ends and of necessarily also assigning to it two recesses in the balance wheel hub in this case, the securing of the balance wheel against rotation is improved and mounting is facilitated at the same time, because two installation positions are now available for the balance wheel instead of one.

The various features of novelty which characterize the invention are pointed out with particularity in the claims annexed to and forming a part of this disclosure. For a better understanding ofthe invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
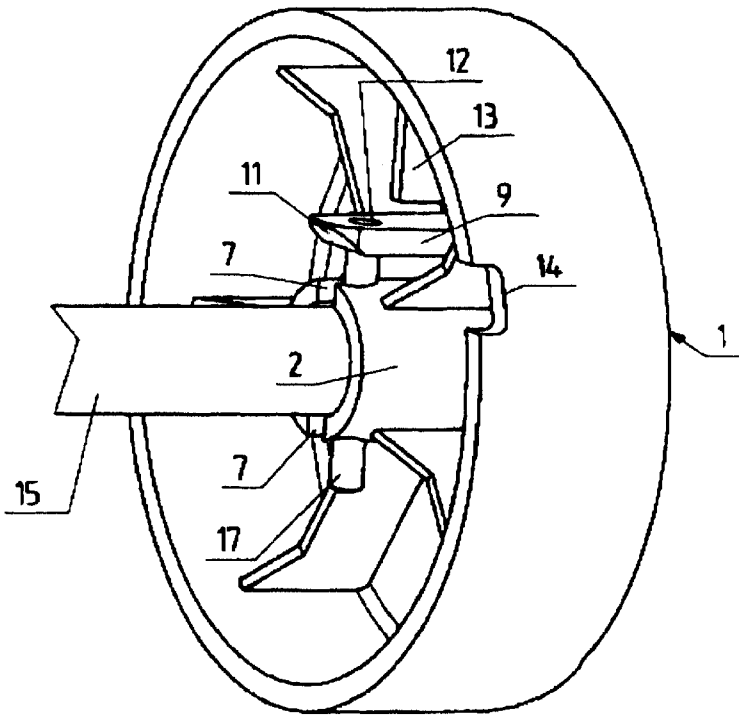
FIG. 2 is a perspective view of the balance wheel and the arm shaft in the mounted state.
Figure 1:
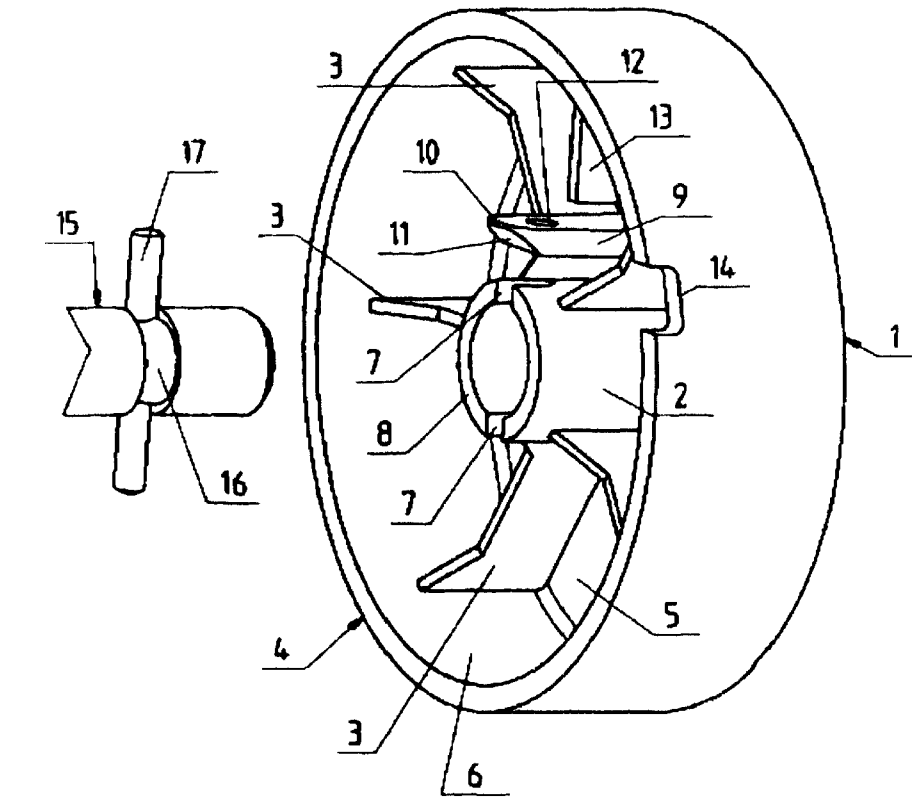
FIG. 1 is a perspective view of the balance wheel and of part of the arm shaft in the removed state.

Referring to the drawings in particular, a balance wheel 1 comprises a hub 2, a plurality of ribs 3 radially protruding from the hub 2 and a pot-shaped outer part 4, which is connected to the ribs and to the front side of the hub and which is composed of a front-side section 5 and a cylindrical section 6. The balance wheel 1 is otherwise a one-piece injection-molded plastic part.

Two mutually opposite recesses 7, which extend from the inner front side 8 of the hub 2 in the axial direction, are provided in the hub 2.

An elastic finger 9 has a rear end rigidly connected to the front-side section 5 of the outer part 4 such that the finger 9. The elastic finger 9 is an integral part of the balance wheel 1 and is manufactured simultaneously during the injection molding. The elastic finger 9 is arranged in the area of one of the two recesses 7 at a radially spaced location from the hub 2. The finger 9 extends in parallel to the longitudinal axis of the hub 2 and has an obliquely downwardly extending, ramp-like bevel 11 as well as a transversely extending mounting hole 12 at its free end 10.

A limiting stop 13 is located at a spaced location from the finger 9 and thus limits the range of bending of the finger 9. The limiting stop 13 is arranged on the inside of the outer part 4 in the area of the finger 9. A recess 14 is located opposite the finger 9. The recess 14 is provided at the edge of the cylindrical section 6.

The arm shaft 15 of the sewing machine, which is shown only partially, has an annular groove 16 and contains a carrier pin 17. The carrier pin 17 is arranged in the area of the annular groove 16 and extends at right angles to the longitudinal axis of the shaft. Two ends of the carrier pin 17 protrude over the arm shaft 15.

For mounting, the balance wheel 1 is pushed with its hub 2 over the end of the arm shaft 15 and is aligned in the process such that the two recesses 7 can accommodate the carrier pin 17. Near the end of the pushing movement, the bevel 11 of the finger 9 slides along on the associated end of the carrier pin 17, as a result of which the finger 9 is bent until its mounting hole 12 comes to lie above the end of the pin, after which the finger 9 springs back into its normal position. As soon as the carrier pin 17 has been inserted into the mounting hole 12, the balance wheel 1 is secured against axial displacement in a positive-locking manner.

To remove the balance wheel 1, a rod-shaped tool, not shown, is passed through the recess 14 to below the finger 9. By bending away the finger 9 in the direction of the limiting stop 13, the finger 9 is separated from the carrier pin 17, after which the balance wheel 1 can be pulled off from the arm shaft 15.

While a specific embodiment of the invention has been shown and described in detail to illustrate the application of the principles of the invention, it will be understood that the invention may be embodied otherwise without departing from such principles.

What is claimed is:

1. A sewing machine arm shaft balance wheel, comprising:

a hub having at least one axially extending recess, the recess being open toward a hub inner front side and corresponding to a radially protruding carrier pin fastened in the arm shaft, said recess being provided in said hub to secure the balance wheel against rotation;

a plurality of ribs protruding from said hub;

a pot-shaped outer part connected to said ribs, said pot-shaped outer part having a front-side section and a cylindrical section; and an elastic holding element provided for axially securing the balance wheel, said elastic holding element comprising an elastic finger connected to the balance wheel and having a free end and arranged extending essentially in parallel to said arm shaft, said elastic finger having a mounting hole for the carrier pin in the area of said free end.

2. The sewing machine in accordance with claim 1, wherein said elastic finger is rigidly connected to the balance wheel by extrusion-coating of its rear end.

3. The sewing machine arm shaft balance wheel in accordance with claim 1, wherein said elastic finger is an integral part of the balance wheel.

4. The sewing machine arm shaft balance wheel in accordance with claim 2, wherein said elastic finger has a ramp-like bevel in the area of said free end and said cylindrical section of said outer part has a recess provided opposite said finger.

5. The sewing machine arm shaft balance wheel in accordance with claim 1, wherein a limiting stop is located at a spaced location from said finger and is fastened to the balance wheel.

6. The sewing machine arm shaft balance wheel in accordance with claim 1, wherein said arm shaft has an annular groove accommodating said carrier pin in an area of said carrier pin.

7. The sewing machine in accordance with claim 1, wherein said carrier pin protrudes from said arm shaft with both ends.

8. A sewing machine arm shaft and balance wheel combination, the combination comprising:

an arm shaft with a radially protruding carrier pin fastened thereto; and a balance wheel comprising:

a hub having at least one axially extending recess, the recess being open toward a hub inner front side and corresponding to a radially protruding carrier pin fastened in the arm shaft, said recess being provided in said hub to secure said balance wheel against rotation;

a plurality of ribs protruding from said hub;

a pot-shaped outer part connected to said ribs, said pot-shaped outer part having a front-side section and a cylindrical section; and an elastic holding element provided for axially securing said balance wheel, said elastic holding element comprising an elastic finger connected to said balance wheel and having a free end and arranged extending essentially in parallel to said arm shaft, said elastic finger having a mounting hole for the carrier pin in the area of said free end.

9. The combination in accordance with claim 8, wherein said elastic finger is rigidly connected to said balance wheel by extrusion-coating of its rear end.

10. The combination in accordance with claim 8, wherein said elastic finger is an integral part of said balance wheel.

11. The combination in accordance with claim 9, wherein said elastic finger has a ramp-like bevel in the area of said free end and said cylindrical section of said outer part has a recess provided opposite said finger.

12. The combination in accordance with claim 8, wherein a limiting stop is located at a spaced location from said finger and is fastened to said balance wheel.

13. The combination in accordance with claim 8, wherein said arm shaft has an annular groove accommodating said carrier pin in an area of said carrier pin.

14. The combination in accordance with claim 8, wherein said carrier pin protrudes from said arm shaft with both ends.

* * * * *